US008366573B2

(12) United States Patent
Hunt

(10) Patent No.: US 8,366,573 B2
(45) Date of Patent: Feb. 5, 2013

(54) LIGHT-EMITTING COMPONENTS FOR ARROWS

(76) Inventor: C. Timothy Hunt, Dadeville, AL (US)

( * ) Notice: Subject to any disclaimer, the term of this patent is extended or adjusted under 35 U.S.C. 154(b) by 0 days.

(21) Appl. No.: 13/040,963

(22) Filed: Mar. 4, 2011

(65) Prior Publication Data

US 2011/0218063 A1 Sep. 8, 2011

Related U.S. Application Data

(60) Provisional application No. 61/310,363, filed on Mar. 4, 2010.

(51) Int. Cl.
*F42B 6/04* (2006.01)

(52) U.S. Cl. ..... 473/586; 473/578

(58) Field of Classification Search ..... 473/578, 473/585, 586, 570
See application file for complete search history.

(56) References Cited

U.S. PATENT DOCUMENTS

| | | | | |
|---|---|---|---|---|
| 3,460,954 | A | 8/1969 | Young | |
| 3,503,764 | A | 3/1970 | Young | |
| 4,275,951 | A | 6/1981 | Beales et al. | |
| 4,856,792 | A * | 8/1989 | Hardison | 473/570 |
| 5,018,450 | A * | 5/1991 | Smith | 102/513 |
| 6,220,978 | B1 * | 4/2001 | Schroeder | 473/586 |
| 6,251,813 | B1 | 6/2001 | Sato | |
| 6,364,499 | B1 * | 4/2002 | Jones | 362/109 |
| 6,641,493 | B1 * | 11/2003 | Shifflett | 473/578 |
| 7,211,011 | B1 * | 5/2007 | Sutherland | 473/578 |
| 7,485,057 | B2 * | 2/2009 | Afshari | 473/586 |
| 2005/0178375 | A1 * | 8/2005 | Sutherland et al. | 124/79 |
| 2006/0084534 | A1 * | 4/2006 | Flowers et al. | 473/578 |
| 2007/0082766 | A1 * | 4/2007 | Smith et al. | 473/578 |
| 2007/0173359 | A1 * | 7/2007 | Mowery et al. | 473/578 |
| 2008/0207362 | A1 * | 8/2008 | Kuhn | 473/586 |
| 2009/0247333 | A1 * | 10/2009 | Bottelsen | 473/585 |

OTHER PUBLICATIONS

Laws, Jerry. "Photoluminescence Shines Through." Occupational Health & Safety. Jun. 1, 2004. 4 pages. Printed from the Internet. Mar. 4, 2011.

Burt Coyote—Lumenok Lighted Arrow Nock. http://www.lumenok.net/.2 pages. Printed from the Internet. Mar. 3, 2010.

Easton Archery—Tracer Nock. http://www.eastonarchery.com/products/tracer. 2 pages. Printed from the Internet. Mar. 3, 2010.

"Color Special Effects Technologies," RTP Imagineering Plastics, Aug. 16, 2012, 6 pgs., <http://www.rtpcompany.com/products/color/effects.htm>.

* cited by examiner

*Primary Examiner* — John Ricci
(74) *Attorney, Agent, or Firm* — Gardner Groff Greenwald & Villanueva, PC

(57) ABSTRACT

Arrow components, such as vanes and nocks, are provided with a light-emitting material for enhancing their visibility to the shooter, a camera, spectators, and/or others attempting to view the flight-path of the shot arrow during low-light conditions. In various embodiments, the light-emitting material is provided by a photo-luminescent material, a chemi-luminescent material, a refractive material, a reflective material, another material that will emit light in low-light conditions, or a composite of these. The light-emitting material is preferably selected for its ability to emit light, upon exposure to natural or artificial light and with no electric power source.

19 Claims, 6 Drawing Sheets

LIGHT-EMITTING COMPONENTS FOR ARROWS

CROSS-REFERENCE TO RELATED APPLICATION

This application claims the priority benefit of U.S. Provisional Patent Application Ser. No. 61/310,363, filed Mar. 4, 2010, which is hereby incorporated hereby by reference.

TECHNICAL FIELD

The present invention relates generally to archery, and in particular, to vanes and nocks of bow-shot arrows with enhanced-visibility illumination features for tracking the arrow in low-light conditions.

BACKGROUND

It's common to want to able see and track the flight of an arrow that's been shot into motion. For example, this can be highly desirable for bow-hunters wanting to be able to track and retrieve a shot arrow. This can also be highly desirable when filming a bow-hunt (e.g., for later viewing by an audience) or an archery practice session (e.g., for diagnosing errors and improving technique), in which it's common for the cameraman to stand behind the arrow shooter to film the arrow's flight-path. And this can be the case for any type of arrow, including bow-shot arrows and crossbow-shot bolts. But in these and other situations the arrow-tracker (e.g., an arrow-shooting person, a camera, or an observing person) is generally in-line with the arrow flight. This is because persons other than the shooter typically stand behind the shooter for safety, to avoid distracting the shooter, and to avoid drawing the attention of the target when hunting. But when the arrow-tracker is generally in-line with the arrow flight, this tends to make it difficult to track the flight of the arrow. This is particularly problematic in low-light conditions, such as when outside during morning and evening twilight, around dawn and dusk, or at night, or when inside (e.g., at a practice range or indoor competition) with little (or no) artificial or natural lighting.

In order to see and track the flight of an arrow that has been shot into motion in low-light conditions, some companies have created nocks with internal electric lights. Nocks are the structures located at rear tip of the arrow shaft, include a slot for receiving the bowstring, and are typically made of a hard plastic material. Known electric-light nocks each include a light-emitting diode (LED) electric light, a battery for electrically powering the light, and an internal control switch for manually or automatically turning on and off the power to the light. In some manual designs, for example, the internal control switch is triggered to turn the light on and off upon manually passing a magnet nearby it. And in some automatic designs, for example, the internal control switch is automatically triggered by the launch force to turn on the light when the arrow is shot, then is automatically reset after a predetermined time to turn the light back off. In some designs, these nocks have electric lights that illuminate constantly, and in other designs they blink.

While these electric-light nocks have proven at least somewhat useful for visually tracking the flight of an arrow at night or in other low-light conditions, they have their drawbacks. In particular, because they are battery powered, they have a limited life (e.g., typically about forty hours) and therefore must be frequently replaced. And due to the frequent replacements required, the overall cost of using them tends to be relatively high. Moreover, these electric-light nocks are not recognized by the two most prestigious record books in the hunting industry, Pope and Young, and Boone and Crockett, and are not legal in many states.

Thus it can be seen that needs exist for improvements to arrows and/or arrow components to provide affordable enhanced-visibility illumination features for tracking the arrows in low-light conditions. It is to such improvements that the present invention is primarily directed.

SUMMARY

Generally described, the present invention relates to arrow components, such as vanes and/or nocks, made including a light-emitting material for enhancing their visibility to the shooter, a camera, spectators, and/or others attempting to view the flight-path of the shot arrow during low-light conditions. In various embodiments, the light-emitting material is provided by a photo-luminescent material, a chemi-luminescent material, a refractive material, a reflective material, another material that will emit light in low-light conditions, or a composite of these. The light-emitting material is preferably selected for its ability to emit light, upon exposure to natural or artificial light and with no electric power source. In some embodiments, the light-emitting material is provided on the entire nock and/or vanes, at only their rear edge surfaces, at their rear edge surfaces and rear portions of their side surfaces, at their entire peripheral edge surfaces, at peripheral portions adjacent their peripheral edge surfaces. And in some other embodiments, the light-emitting material is provided on vane attachments such as a coating (e.g., a liquid sprayed on or for dipping into), a layer (e.g., adhesive-backed strips), or a geometric member (e.g., a wedge) mounted onto the vanes.

The specific techniques and structures employed to improve over the drawbacks of the prior devices and methods and accomplish the advantages described herein will become apparent from the following detailed description of example embodiments and the appended drawings and claims.

DETAILED DESCRIPTION OF EXAMPLE EMBODIMENTS

The present invention may be understood more readily by reference to the following detailed description of example embodiments taken in connection with the accompanying drawing figures, which form a part of this disclosure. Generally described, the present invention relates to components of arrows with enhanced-visibility illumination features for tracking the arrow in low-light conditions. As used herein, low-light conditions include outside during morning and evening twilight, around dawn and dusk, or at night (including complete darkness), or inside with little (or no) artificial or natural lighting.

Figure 1:
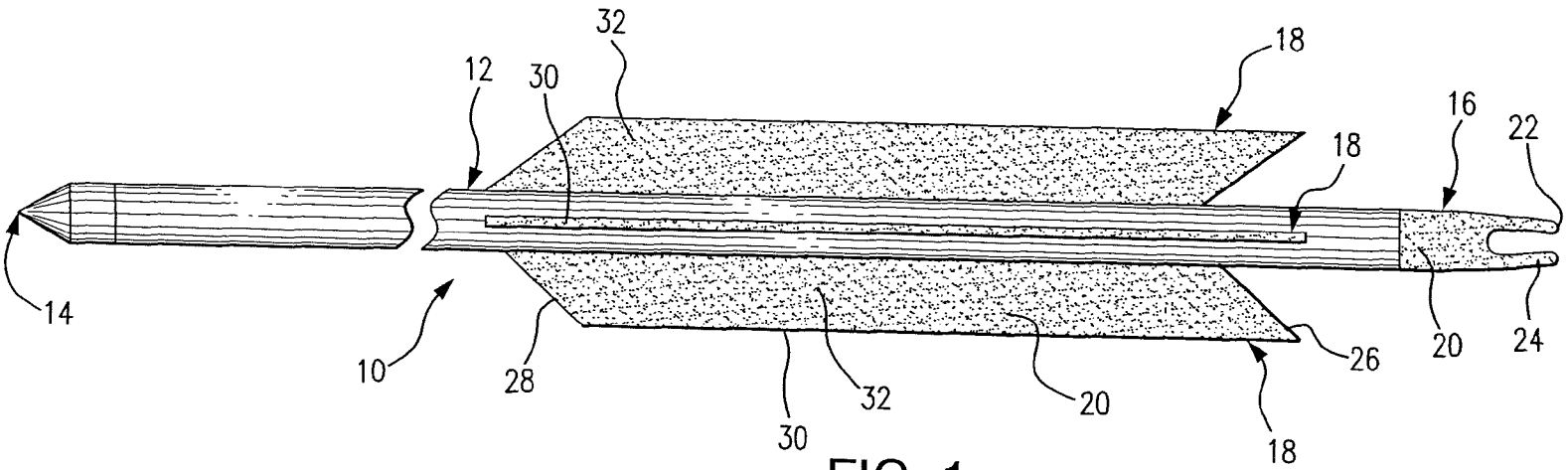
FIG. 1 is a side view of a portion of an arrow with a light-emitting nock and vanes according to a first example embodiment of the prevent invention.
Figure 2:
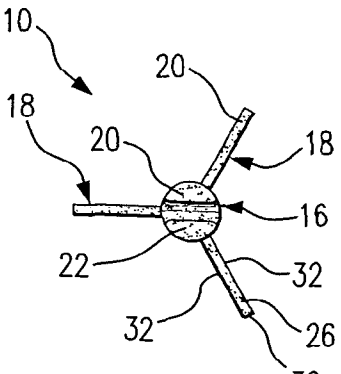
FIG. 2 is a rear view of the arrow of FIG. 1, showing light-emitting rear surfaces of the vane edges and nock.
Figure 3:
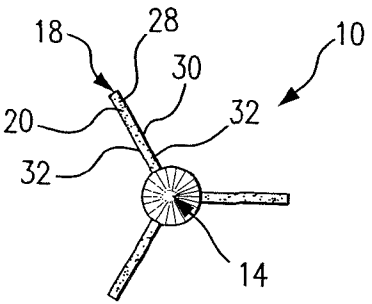
FIG. 3 is a front view of the arrow of FIG. 1, showing light-emitting front surfaces of the vane edges.

FIGS. 1-3 show an arrow 10 according to a first example embodiment of the present invention. The arrow 10 has a shaft 12 with an arrowhead tip 14, a slotted nock 16 at the rear tip of the shaft, and three vanes 18 mounted at the rear portion of the arrow shaft to guide and stabilize the arrow in flight. The vanes 18 (also known as fletchings) can be of a typical length, for example, about two inches to about four inches long. In this regard, this is a conventional arrow that can be used in target shooting, game hunting, competitive archery, etc.

In the depicted embodiment, however, the nock 16 and the vanes 18 of the arrow 10 include a light-emitting material 20. The light-emitting material 20 can be a photo-luminescent material, a chemi-luminescent material, a refractive material, a reflective material, another material that will emit light in low-light conditions, or a composite of these. The light-emitting material 20 is preferably selected for its ability to emit light, in response to exposure to natural or artificial light (preferably visible light) and with no electric power source, such that the flight path of the arrow can be seen or visualized in low-light conditions by the arrow shooter, a camera (e.g., when filming hunts and/or competitions), spectators, or others, in such normal use of the arrow. Preferably, the light-emitting material 20 is selected for its ability to emit light in this way but with no action required by the user to maintain the illumination of the material in low-light conditions during the normal use of the arrow so that the visibility of the arrow is enhanced in the low-light conditions. Thus, the inclusion of the light-emitting material 20 in the nocks 16 and/or vanes 18 produces a light-powered illumination, instead of being battery powered. In this way, these self-illuminating solar nocks and/or vanes fall within current rules and regulations, and as such are believed to be legal in all states in the U.S. and compliant with Pope and Young and by Boone and Crockett.

In some typical embodiments, the light-emitting material 20 is a photo-luminescent material selected for its ability to absorb light, including natural light (i.e., sunlight) and/or artificial light (e.g., from electric lighting), when exposed to such light, and to thereafter emit visible light for a period of time. Photoluminescence is a process in which a substance absorbs photons (electromagnetic radiation) and then re-radiates photons. The photo-luminescent properties of the photo-luminescent material of the nock 16 and the vanes 18 can last indefinitely, as the material is recharged for future luminescence anytime it is exposed to light. Thus, the photo-luminescent material of the nock 16 and the vanes 18 absorbs light during the day and then emits light in low-light conditions, so no electric power source is needed and no action is required by the user to maintain the illuminating capability of the arrow. An artificial light source can be shined on the photo-luminescent material of the nock 16 and the vanes 18 for a faster charge (if they have not been exposed to light until just before use) or for a recharge in low-light conditions.

The nock 16 and the vanes 18 of the arrow 10 have bodies that can be made of base materials that are mixed, impregnated, coated, or otherwise formed with the additive photo-luminescent material. The base materials can be of the type commonly used in making nocks and vanes, such as hard plastic for the nocks and soft plastic for the vanes. For example, the photo-luminescent material can be mixed or impregnated into the plastic at the time of, or sometime before, the manufacture (e.g., by injection molding or thermoplastic molding) of the nock 16 and/or the vanes 18, as is the case with the depicted embodiment. As other examples, the photo-luminescent material can be included in a pigment, paint, adhesive wrap, or film that is applied to or impregnated into the nock 16 and/or the vanes 18. When the photo-luminescent material 20 is provided in the form of a paint or adhesive wrap/film/strip, it can be retrofitted onto existing nocks 16 and/or vanes 18.

The photo-luminescent material can be a conventional "glow-in-the-dark" material of a type that is commercially available. For example, the photo-luminescent material can be strontium oxide aluminate or strontium aluminate (activated with a suitable dopant). Strontium oxide aluminate is nontoxic and nonradioactive for safety purposes, and is known to be used in fiber optics and other light-transmission applications. When using commercially available strontium oxide aluminate, a high concentration (e.g., about 50 percent to about 90 percent by weight, depending on the desired glow-time) of this material can be included so that the nock 16 and/or the vanes 18 fully charge in about ten minutes of exposure to direct sunlight and then glow for about twenty hours. Alternatively, the photo-luminescent material can be provided by a commercially available fluorescent or phosphorous material, or by any other photo-luminescent material.

In some other alternative embodiments, the light-emitting material 20 is a commercially available chemi-luminescent material such as the type used in conventional "glow sticks." In such embodiments, the vanes and/or nocks include an outer container holding a first solution and an internal second container, with the internal second container being breakable (e.g., made of a glass material) and holding a second solution that mixes with the first solution when broken. In such embodiments, the vanes and/or nocks need to be manipulated (e.g., twisted or bent to a "snap" break of the internal container) so that when mixed the two solutions chemically interact and emit light by chemi-luminescence.

And in some other alternative embodiments, the light-emitting material 20 is a refractive and/or reflective material. Such refractive material can be a glass, plastic, etc., and such reflective material can be a metallic material, etc., selected for its ability to emit light, upon exposure to natural or artificial light and with no electric power source, such that the flight path of the arrow can be seen or visualized in low-light conditions by the arrow shooter, a camera (e.g., when filming hunts and/or competitions), spectators, or others, in such normal use of the arrow.

In all of the drawing figures, the light-emitting material 20 is indicated by stippling/shading. So in the depicted embodiment, the light-emitting material 20 is generally visible from the side (see FIG. 1), on the side surfaces 32 of the nock 16, the side surfaces 32 of the vanes 18, and the top edge surfaces 30 of the vanes, as the arrow 10 rotates along its flight-path. The light-emitting material 20 is generally visible from the rear (see FIG. 2) on the rear edge surfaces 22 of the vanes 18 and the rear edge surfaces 26 of the vanes 18. And the light-emitting material 20 is generally visible from the front (see FIG. 3) on the front edge surfaces 28 of the vanes 18. This can be useful for target practice or other situations in which high visibility is key and there is no need to prevent the light-emitting material 20 from being seen from the front (e.g., by the target) or from the side (e.g., by the target or others).

Figure 4:
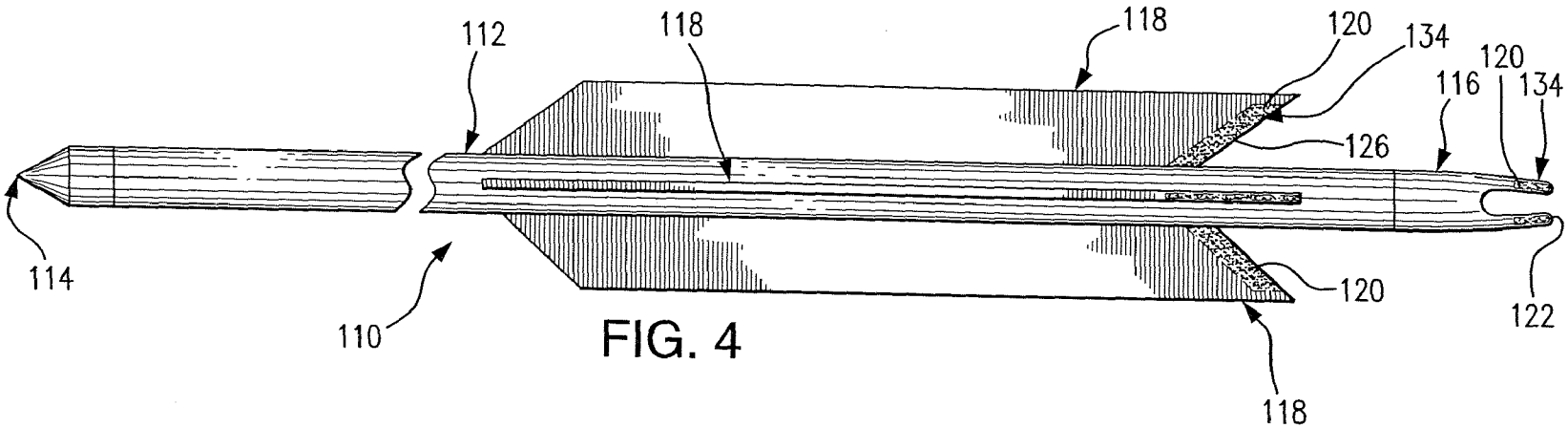
FIG. 4 is a side view of a portion of an arrow with a light-emitting nock and vanes according to a second example embodiment of the prevent invention.
Figure 5:
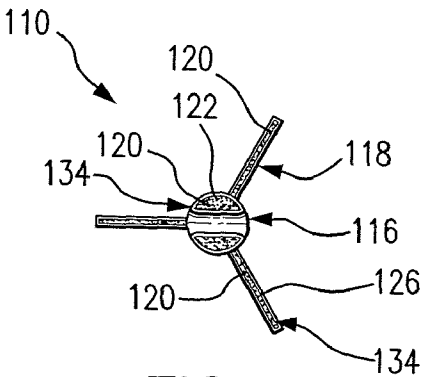
FIG. 5 is a rear view of the arrow of FIG. 4, showing light-emitting rear surfaces of the vane edges and nock.
Figure 6:
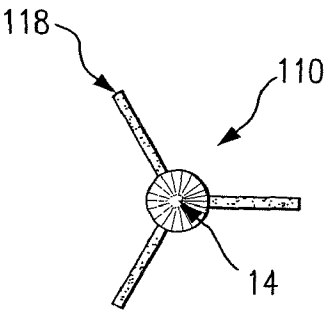
FIG. 6 is a front view of the arrow of FIG. 4, showing front surfaces of the vane edges not emitting light.

FIGS. 4-6 show an arrow 110 according to a second example embodiment of the present invention. The arrow 110 has a shaft 112 with an arrowhead tip 114, a slotted nock 116 at the rear tip of the shaft, and three vanes 118 mounted at the rear portion of the arrow shaft to guide and stabilize the arrow in flight. As such, the arrow 110 of this embodiment is similar to that of the first embodiment.

However, in this embodiment the nock 116 and the vanes 118 of the arrow 110 include the light-emitting material 120 only at their rear portions. In particular, the light-emitting material 120 is included in vane attachments 134 located only at the rear edge surfaces 122 and 126 of the nock 116 and the vanes 118, respectively. In the depicted embodiment, the attachments 134 are provided by inserts (such as thin sheets, plugs or T-shaped members) that are received in openings in the rear edge surfaces 122 and 126 of the nock 116 and the vanes 118, respectively. The nock 116 and vanes 118 can be made of conventional materials (e.g., plastics), and at least the portions of them laterally adjacent the openings can be opaque (or only minimally translucent) to avoid transmitting light through them. In such embodiments, light-emitting materials 120 that are photo-luminescent or reflective tend to work especially well. So the light-emitting material 20 is generally visible from the rear (see FIG. 5), but not from the side (see FIG. 4) or the front (see FIG. 6). This can be useful for hunting or other situations in which it is desirable to prevent the light-emitting material 120 from being seen from the front (e.g., by the animal or other target) or from the side (e.g., by the target or others), while permitting it to be highly visible from the rear (e.g., by the shooter and/or the cameraman).

Figure 7:
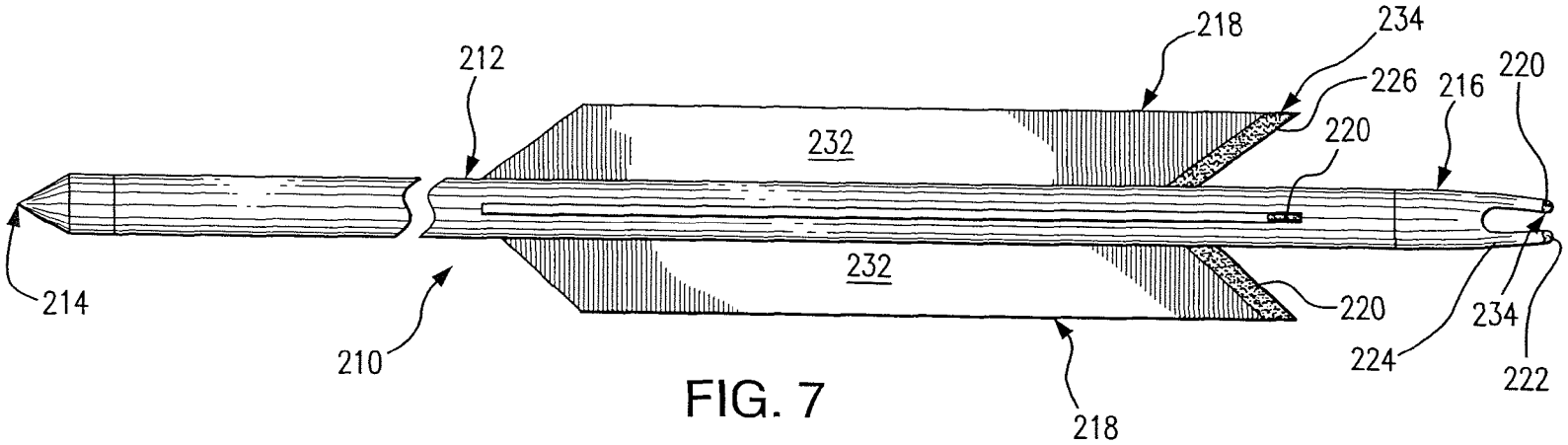
FIG. 7 is a side view of a portion of an arrow with a light-emitting nock and vanes according to a third example embodiment of the prevent invention.
Figure 8:
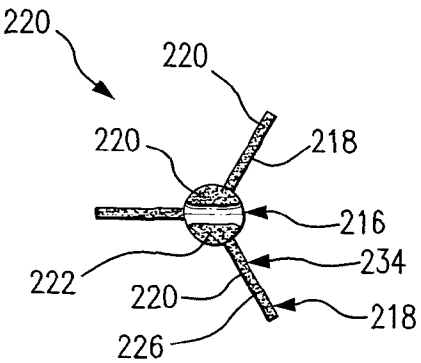
FIG. 8 is a rear view of the arrow of FIG. 7, showing light-emitting rear surfaces of the vane edges and nock.
Figure 9:
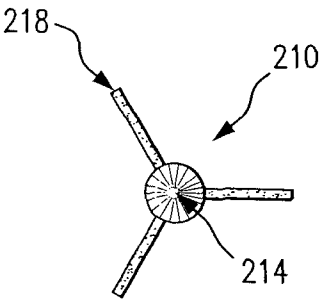
FIG. 9 is a front view of the arrow of FIG. 7, showing front surfaces of the vane edges not emitting light.

FIGS. 7-9 show an arrow 210 according to a third example embodiment of the present invention. The arrow 210 has a shaft 212 with an arrowhead tip 214, a slotted nock 216 at the rear tip of the shaft, and three vanes 218 mounted at the rear portion of the arrow shaft to guide and stabilize the arrow in flight. As such, the arrow 210 of this embodiment is similar to that of the second embodiment in that the nock 216 and the vanes 218 of the arrow include the light-emitting material 220 only at their rear portions.

However, in this embodiment the light-emitting material 220 is applied as a coating or layer 234 to the rear edge surfaces 222 and 226 of the nock 216 and/or the vanes 218, respectively, of the arrow 210. Typically, the coating or layer 234 is also applied to the rear portions of the side surfaces 224 and 232 of the nock 216 and/or the vanes 218, respectively, adjacent their rear edge surfaces 222 and/or 226, as is depicted. The vane body itself is made of a conventional base material such as a plastic. In some embodiments, the coating or layer 234 is applied as an adhesive-backed strip (e.g., a sheet or film) made of a base material selected for durability (e.g., plastic) with the light-emitting material coated onto it or integrally made (e.g., molded) with it. In other embodiments, the coating or layer 234 is applied in liquid (including atomized) form by being sprayed on, by dipping the nocks and vanes into a vat of the liquid, etc., with the liquid including the light-emitting material 220 mixed into a liquid base material that coats and dries in place. In such embodiments, light-emitting materials 220 that are photo-luminescent or reflective tend to work especially well. So the light-emitting material 220 is highly visible from the rear (see FIG. 8), but is not visible from the side (see FIG. 7) or the front (see FIG. 9).

Figure 10:
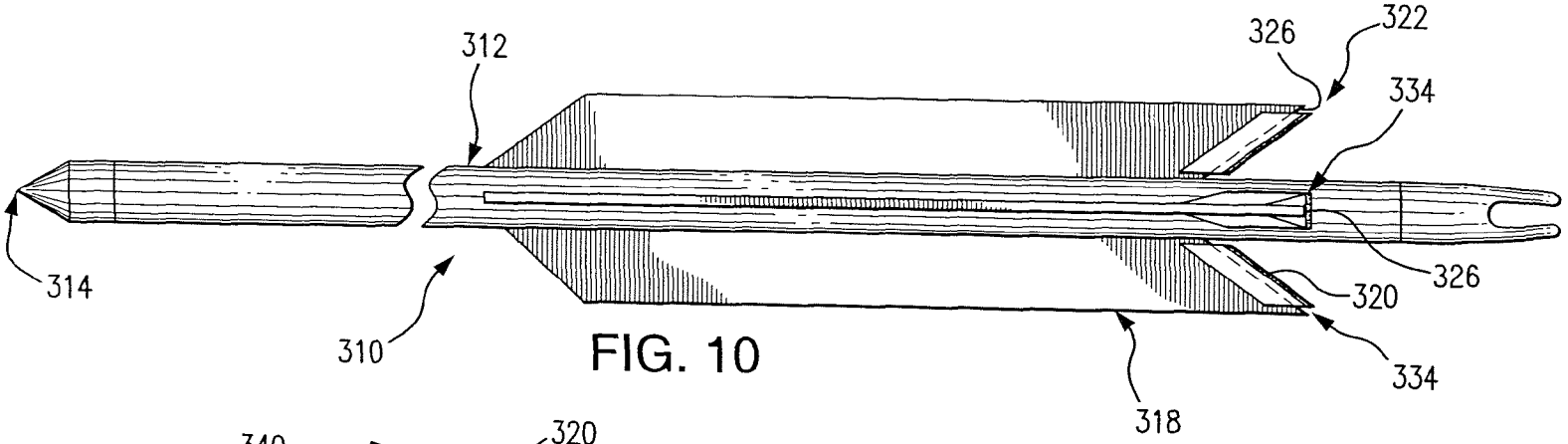
FIG. 10 is a side view of a portion of an arrow with light-emitting vanes according to a fourth example embodiment of the prevent invention, showing vane attachments mounted onto rear edges of the vanes.
Figure 11:
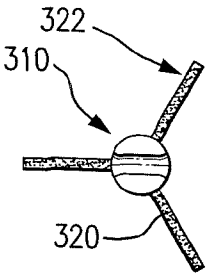
FIG. 11 is a rear view of the arrow of FIG. 10, showing light-emitting rear surfaces of the vane attachments on the vane edges.
Figure 12:
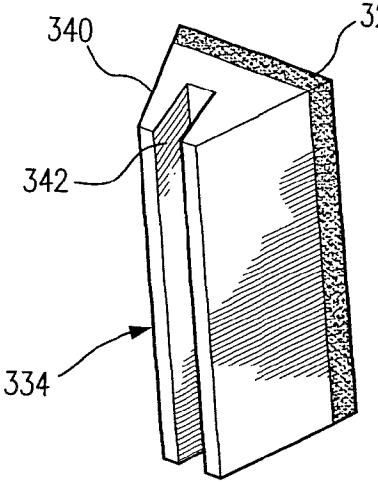
FIG. 12 is a perspective view of one of the vane attachments of FIG. 10, showing front surfaces of the vane attachments not emitting light.

FIGS. 10-12 show an arrow 310 according to a fourth example embodiment of the present invention. The arrow 310 has a shaft 312 with an arrowhead tip 314, a slotted nock 316 at the rear tip of the shaft, and three vanes 318 mounted at the rear portion of the arrow shaft to guide and stabilize the arrow in flight. As such, the arrow 310 of this embodiment is similar to that of the second and third embodiments in that the vanes 318 of the arrow include the light-emitting material 320 only at their rear portions.

However, in this embodiment the light-emitting material 320 is included in vane attachments 334 mounted only at the rear edge surfaces 326 of the vanes 318. In the depicted embodiment, the vane attachments 334 can be retrofitted onto existing vanes 318 of existing arrows 310. The vane attachments 334 each have a geometric body 340 with a slot 342 formed in it sized and shaped for receiving the rear edge 326 of the vane 318. In the depicted embodiment, the vane attachment body 340 is generally wedge-shaped for good aerodynamics, with tapering sides forming a larger rear end surface area where the light-emitting material 320 is placed for high visibility from behind (but not from the front or sides). Alternatively, the body of the vane attachment can be flat with the rear end area where the light-emitting material 320 is placed not being enlarged, or it can have another geometric shape such as an oval or a polygon. The slot 342 of the vane attachment 334 can include gripping features (e.g., ribs, ridges, or nubs) for holding a good grip to the vane 318 during flight. Alternatively, the slot of the vane attachment and the rear edge of the vane can include mating features (e.g., snap-fit couplings) for securing the attachment to the vane, or the vane attachments can be bonded to the vanes for example by an epoxy. And in other alternatives, a similarly constructed attachment can be provided for attaching to the nock.

Figure 13:
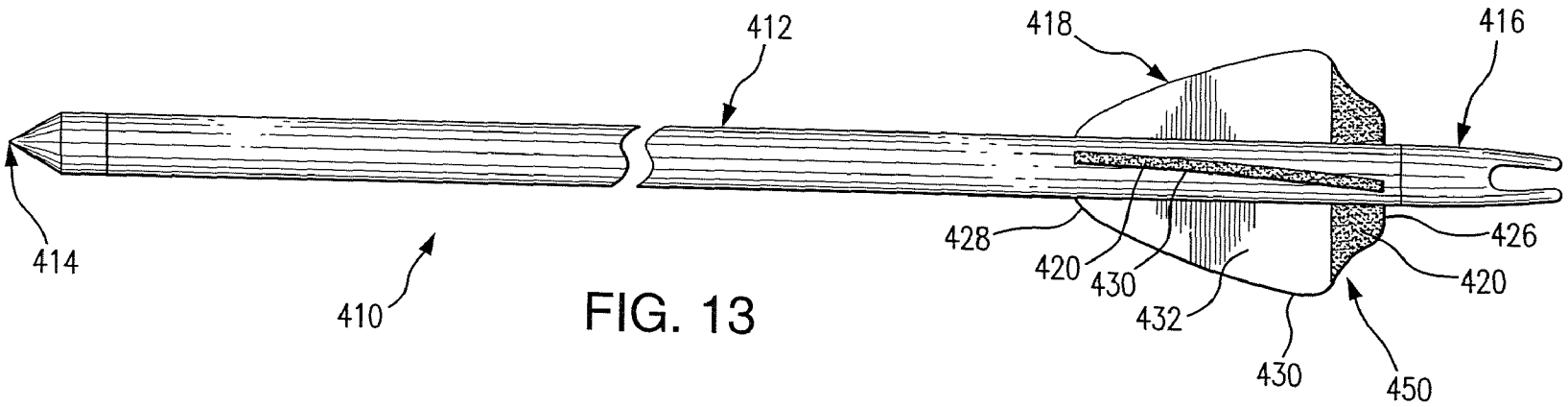
FIG. 13 is a side view of a portion of an arrow with light-emitting vanes according to a fifth example embodiment of the prevent invention.
Figure 14:
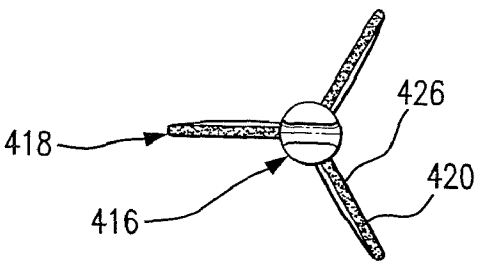
FIG. 14 is a rear view of the arrow of FIG. 13, showing light-emitting rear surfaces of the vane edges.
Figure 15:
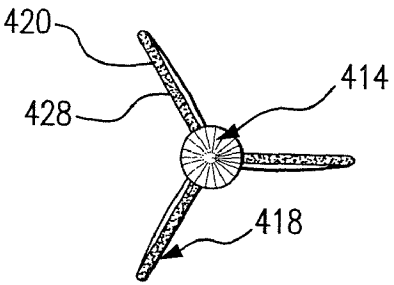
FIG. 15 is a front view of the arrow of FIG. 13, showing light-emitting front surfaces of the vane edges.

FIGS. 13-15 show an arrow 410 according to a fifth example embodiment of the present invention. The arrow 410 has a shaft 412 with an arrowhead tip 414, a slotted nock 416 at the rear tip of the shaft, and three vanes 418 mounted at the rear portion of the arrow shaft to guide and stabilize the arrow in flight. As such, the arrow 410 of this embodiment is similar to that of the second and third embodiments described herein.

However, in this embodiment the light-emitting material 420 is included, not only at the rear edge surface 426 of each of the vanes 418, but also at the peripheral top and front edge surfaces 428 and 430 and also at oppositely-facing rear portions 450 of the side surfaces 432 of the body of the vane. In typical embodiments, the rear portions 450 of the side surfaces 432 of the body of the vane 418 extend the entire vertical height of the vane (at the rear end) and extend about ⅛ to about ⅜ of the horizontal length of the vane (so they're typically about 1/16 to about ½ inch long).

The vane body can be made of a base material (e.g., plastic) that is mixed or impregnated with a light-emitting material 420, for example using conventional injection-molding techniques and equipment, similarly to the first embodiment described herein. And then the portion of each of the side surfaces 432 of each of the vanes 418 that is to be non-light-emitting is covered with an opaque coating or layer such as a coating (e.g., paint) or sheets of adhesive-backed film (e.g., plastic strips). This leaves exposed the rear portions 450 of each of the side surfaces 432, as well as the peripheral rear, top, and front edge surfaces 426, 428, and 430, of the vane 418.

In addition, in the depicted embodiment the vanes 418 are mounted to the arrow shaft 412 not exactly axially but instead slightly helically to induce shaft rotation for accuracy. Thus, a relatively small portion of the side surfaces 432 of the vanes is visible from the front (see FIG. 15) and behind (see FIG. 14) even when standing directly in-line with the flight-path of the arrow 410. Including the light-emitting material 420 at the rear portion 450, in continuity with (and immediately adjacent) the rear edge surface 426, tends to magnify the rearward light-emission and thereby add to the from-behind enhanced-visibility performance of the arrow 410 while not rendering the arrow significantly more visible from the front. Moreover, spectators and cameras are typically not precisely inline with the flight-path (they're commonly at least a little off-line), but the target is (if the shot is on target), and for this additional reason this arrangement tends to add to the from-behind enhanced-visibility performance of the arrow 410 while not rendering the arrow significantly more visible from the front.

Figure 16:
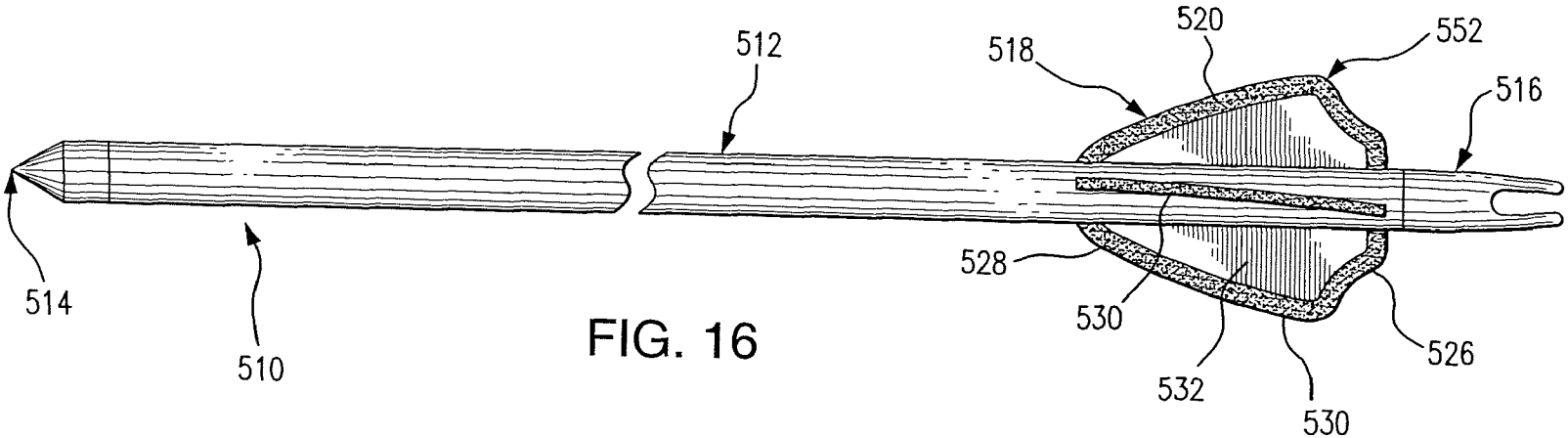
FIG. 16 is a side view of a portion of an arrow with light-emitting vanes according to a sixth example embodiment of the prevent invention.
Figure 17:
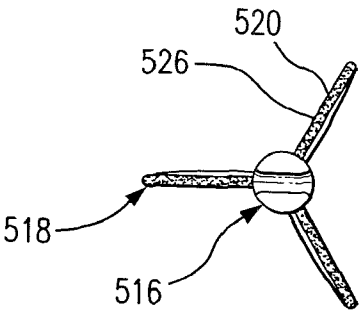
FIG. 17 is a rear view of the arrow of FIG. 16, showing light-emitting rear surfaces of the vane edges.
Figure 18:
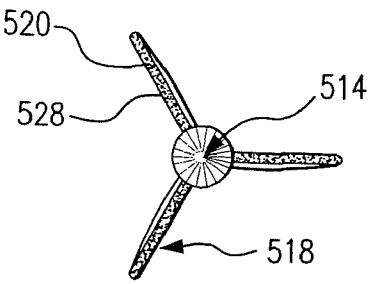
FIG. 18 is a front view of the arrow of FIG. 16, showing light-emitting front surfaces of the vane edges.

FIGS. 16-18 show an arrow 510 according to a sixth example embodiment of the present invention. The arrow 510 has a shaft 512 with an arrowhead tip 514, a slotted nock 516 at the rear tip of the shaft, and three vanes 518 mounted at the rear portion of the arrow shaft to guide and stabilize the arrow in flight. As such, the arrow 510 of this embodiment is similar to that of the second, third, and fifth embodiments described herein.

However, in this embodiment the light-emitting material 520 is included, not only at the rear edge surface 526 of each of the vanes 518, but also at the peripheral top and front edge surfaces 528 and 530 and also at a peripheral portion 552 of each of the side surfaces 532 of the body of the vane. In typical embodiments, the peripheral portions 552 of the side surfaces 532 of the vane 518 extend along and are in continuity with the peripheral rear, top, and front edge surfaces 526, 528, and 530 of the vane, and have a lateral dimension (height at the top and length at the front and rear) of about ⅛ to about ⅜ of the vertical height of the vane (so they're typically about 1/16 to about 3/16 inch wide).

While the invention has been described with reference to several example embodiments, persons of ordinary skill in the art will understand that it can be embodied in various other forms. In alternative embodiments, only the nock or only the vanes (including the vane attachments) include the light-emitting material. And in other embodiments, another component of the arrow, such as the tip or the shaft, includes the light-emitting material. Thus, in some embodiments the light-emitting material is included in a coating or layer applied to the entire shaft, a rear portion of the shaft, a narrow annular band of the shaft, etc., with the coating or layer wrapped around or integrally formed with the shaft.

In other alternative embodiments, the nock, the vanes, and/or the vane attachments (including the light-emitting material) are provided in a retrofit kit for adding onto existing arrows. The nock can include internal threading that mates with external threading on existing arrow shafts so it can be screwed onto existing arrows (after the existing nock is unscrewed and removed from the arrow shaft). The vanes can include snap-fit, adhesive-strip, or other types of couplings for mounting to existing arrows. And the vane attachments (and customized vanes) can include couplings such as those described herein for mounting to existing arrows. Thus, the kit can include vane attachments in the form of adhesive-backed strips or a small container of liquid, with the strips or liquid including the light-emitting material so that the light-emitting material can be applied to the nock and/or vanes of existing arrows by the user.

In yet other alternative embodiments, the nock and/or the vanes (including the vane attachments) include multiple types of light-emitting material. For example, the vanes can include a refractive material and the nock can include a photo-luminescent material, or the vanes can include a refractive material at one portion of the vane body and a photo-luminescent material at another portion of the vane body.

And in still other alternative embodiments, the portions of the vanes that are to be light-emitting (e.g., the rear edge surface and the rear portion of the side surfaces) are made of a first material (e.g., a composite of plastic and the light-emitting material), and the remaining portions of the vanes that are to be non-light-emitting are made of a second material (e.g., a soft plastic). The vanes can be integrally formed as a single piece of the first and second materials, or the two sections can be formed separately and then bonded together by conventional techniques.

The various features of the above-described embodiments can be recombined into other embodiments not expressly described herein. For example, the light-emitting portions of the vanes of FIGS. 7-9 can be provided by making the entire vane body out of a base material impregnated with a light-emitting material and then covering the non-light-emitting portions with an opaque coating or layer as in the vanes of FIGS. 13-15, and such embodiments are included within the scope of the present invention.

Also, it should be noted that the arrows, nocks, and vanes depicted in the drawing figures are representative of the present invention but are not necessarily shown to scale. Instead, the scale is exaggerated to illustrate innovative features of the present invention. Furthermore, the drawings show the vanes of FIGS. 1-12 mounted to their arrows axially, and the vanes of FIGS. 13-18 mounted to their arrows not exactly axially but instead slightly helically to induce shaft rotation for accuracy. It will be understood that the vanes of the various embodiments described herein can be mounted to their arrow shafts either way and still perform their enhanced visibility function very well. Moreover, while the drawings show the arrows each having three vanes, it will be understood that more or fewer of the vanes can be provided on an arrow, as may be desired.

It is to be understood that this invention is not limited to the specific devices, methods, conditions, and/or parameters described and/or shown herein, and that the terminology used herein is for the purpose of describing particular embodiments by way of example only and is not intended to be unnecessarily limiting of the claimed invention. Also, as used in the specification including the appended claims, the singular forms "a," "an," and "the" include the plural, and reference to a particular numerical value includes at least that particular value, unless the context clearly dictates otherwise. Ranges may be expressed herein as from "about" one particular value and/or to "about" another particular value. When such a range is expressed, another embodiment includes from the one particular value and/or to the other particular value. Similarly, when values are expressed as approximations, by use of the antecedent "about," it will be understood that the particular value forms another embodiment.

While the invention has been described with reference to preferred and example embodiments, it will be understood by those skilled in the art that a variety of modifications, additions and deletions are within the scope of the invention, as defined by the following claims.

What is claimed is:

1. A component of a bowshot arrow, comprising:

a body having side surfaces with all or substantially all portions thereof including non-light-emitting material and having a rear edge surface including a light-emitting material, the light-emitting material selected and positioned to emit light, in response to exposure to natural or artificial light and with no electric power source, such that when the body is mounted to the bowshot arrow and the bowshot arrow is shot into flight the light-emitting material is generally visible from the rear but not generally visible from the front or sides so that a flight path of the bowshot arrow can be seen and tracked in low-light conditions from the rear by a shooter or camera operator but not from the front or sides by a target animal.

2. The arrow component of claim 1, wherein the arrow component is a nock or a vane.

3. The arrow component of claim 1, wherein the light-emitting material is a photo-luminescent material.

4. The arrow component of claim 1, wherein only the rear edge surface of the body includes the light-emitting material.

5. The arrow component of claim 1, wherein the rear edge surface of the body, and oppositely-facing rear portions of the side surfaces of the body adjacent and in continuity with the rear edge surface, include the light-emitting material.

6. The arrow component of claim 1, wherein peripheral edge surfaces of the body, including the rear edge surface, include the light-emitting material.

7. The arrow component of claim 6, wherein peripheral portions of the side surfaces of the body adjacent and in continuity with the peripheral edge surfaces include the light-emitting material.

8. The arrow component of claim 1, further comprising an attachment that is located on the arrow component, wherein the attachment is a coating, layer, insert, or geometric member, and the light-emitting material is included in the attachment.

9. An attachment for a non-light-emitting vane of a bowshot arrow, comprising:

a body having a rear edge surface including a light-emitting material, the light-emitting material selected and positioned to emit light, in response to exposure to natural or artificial light and with no electric power source, such that when the attachment is mounted to the vane, the vane is mounted to the bowshot arrow, and the bowshot arrow is shot into flight, the light-emitting material is generally visible from the rear but not generally visible from the front or sides so that a flight path of the bowshot arrow can be seen and tracked in low-light conditions from the rear by a shooter or camera operator but not from the front or sides by a target animal.

10. The arrow attachment of claim 9, wherein the light-emitting material is a photo-luminescent material.

11. The arrow attachment of claim 9, wherein the attachment is a coating, layer, insert, or geometric member.

12. The arrow attachment of claim 9, wherein the body further comprises a slot for receiving a rear edge of the vane to mount the attachment to the vane.

13. A bowshot arrow, comprising:

a shaft with an arrowhead tip and a rear portion;

a slotted nock at the rear portion of the shaft; and three vanes at the rear portion of the shaft, wherein the vanes are each provided by a body having side surfaces with all portions thereof including non-light-emitting material and having a rear edge surface including a light-emitting material, the light-emitting material selected and positioned to emit light, in response to exposure to natural or artificial light and with no electric power source, such that when the bowshot arrow is shot into flight the light-emitting material is generally visible from the rear but not generally visible from the front or sides so that a flight path of the bowshot arrow can be seen and tracked in low-light conditions from the rear by a shooter or camera operator but not from the front or sides by a target animal.

14. The arrow of claim 13, wherein the light-emitting material is a photo-luminescent material.

15. The arrow of claim 13, wherein only the rear edge surface of the body includes the light-emitting material.

16. The arrow of claim 13, wherein the rear edge surface of the body, and oppositely-facing rear portions of the side surfaces of the body adjacent and in continuity with the rear edge surface, include the light-emitting material.

17. The arrow of claim 13, wherein peripheral edge surfaces of the body, including the rear edge surface, include the light-emitting material.

18. The arrow of claim 17, wherein peripheral portions of the side surfaces of the body adjacent and in continuity with the peripheral edge surfaces include the light-emitting material.

19. The arrow component of claim 13, further comprising an attachment that is located on the arrow component, wherein the attachment is a coating, layer, insert, or geometric member, and the light-emitting material is included in the attachment.

* * * * *